US011608142B1

(12) United States Patent
Jarvis

(10) Patent No.: US 11,608,142 B1
(45) Date of Patent: Mar. 21, 2023

(54) UNDERWATER DOCK PLATFORM

(71) Applicant: Joseph Jarvis, Etobicoke (CA)

(72) Inventor: Joseph Jarvis, Etobicoke (CA)

( * ) Notice: Subject to any disclaimer, the term of this patent is extended or adjusted under 35 U.S.C. 154(b) by 178 days.

(21) Appl. No.: 17/080,907

(22) Filed: Oct. 27, 2020

(51) Int. Cl.
*B63B 27/14* (2006.01)
*B63B 17/00* (2006.01)

(52) U.S. Cl.
CPC ..... *B63B 27/14* (2013.01); *B63B 17/00* (2013.01); *B63B 27/146* (2013.01)

(58) Field of Classification Search
CPC ... B63B 17/00; B63B 27/14; B63B 2027/141; B63B 27/143; B63B 27/146; B63B 27/148; E06C 1/36; E06C 1/383; E06C 1/3835; E06C 1/387; E06C 1/39; E06C 1/393; E06C 9/085
See application file for complete search history.

(56) References Cited

U.S. PATENT DOCUMENTS 3,231,043 A * 1/1966 Brown ..... E04G 3/18 182/55
3,813,703 A 6/1974 Beaudin
4,022,293 A * 5/1977 Hallagin ..... E04G 5/062 182/152
4,495,883 A * 1/1985 Hoy ..... B63B 27/14 114/364
4,907,674 A * 3/1990 Miller ..... B62B 1/125 280/30
6,401,861 B1 * 6/2002 Marszalek ..... B60R 3/02 182/86
6,793,039 B2 9/2004 Schmid, Jr.
D506,583 S 6/2005 Salonen
9,334,021 B1 5/2016 Fielding
10,458,138 B2 10/2019 Masterson

FOREIGN PATENT DOCUMENTS

WO 2019083651 5/2019

* cited by examiner

*Primary Examiner* — Ajay Vasudeva
(74) *Attorney, Agent, or Firm* — Kyle A. Fletcher, Esq.

(57) ABSTRACT

The underwater dock platform is a platform that is suspended into water. The underwater dock platform is hung from a structure selected from the group consisting of a vessel or a dock such that a client is supported on the underwater dock platform while working at the waterline of the selected structure. The underwater dock platform comprises a plurality of hook structures, a plurality of crossbeams, a dock platform, and a plurality of fasteners. The plurality of fasteners assemble the plurality of hook structures, the plurality of crossbeams, and the dock platform into the underwater dock platform. The plurality of crossbeams brace the plurality of hook structures. The dock platform forms a horizontal supporting surface for the client. The underwater dock platform is a collapsible structure that rotates between a deployed position and a collapsed position.

19 Claims, 7 Drawing Sheets

UNDERWATER DOCK PLATFORM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation including vessels and structures for docking, more specifically, an accessory for a vessel docking structure. (B63B35/00)

SUMMARY OF INVENTION

The underwater dock platform is a platform that is suspended into water. The underwater dock platform is hung from a structure selected from the group consisting of a vessel or a dock such that a client is supported on the underwater dock platform while working at the waterline of the selected structure. The underwater dock platform comprises a plurality of hook structures, a plurality of crossbeams, a dock platform, and a plurality of fasteners. The plurality of fasteners assemble the plurality of hook structures, the plurality of crossbeams, and the dock platform into the underwater dock platform. The plurality of crossbeams brace the plurality of hook structures. The dock platform forms a horizontal supporting surface for the client. The underwater dock platform is a collapsible structure that rotates between a deployed position and a collapsed position.

These together with additional objects, features and advantages of the underwater dock platform will be readily apparent to those of ordinary skill in the art upon reading the following detailed description of the presently preferred, but nonetheless illustrative, embodiments when taken in conjunction with the accompanying drawings.

In this respect, before explaining the current embodiments of the underwater dock platform in detail, it is to be understood that the underwater dock platform is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the underwater dock platform.

It is therefore important that the claims be regarded as including such equivalent construction insofar as they do not depart from the spirit and scope of the underwater dock platform. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
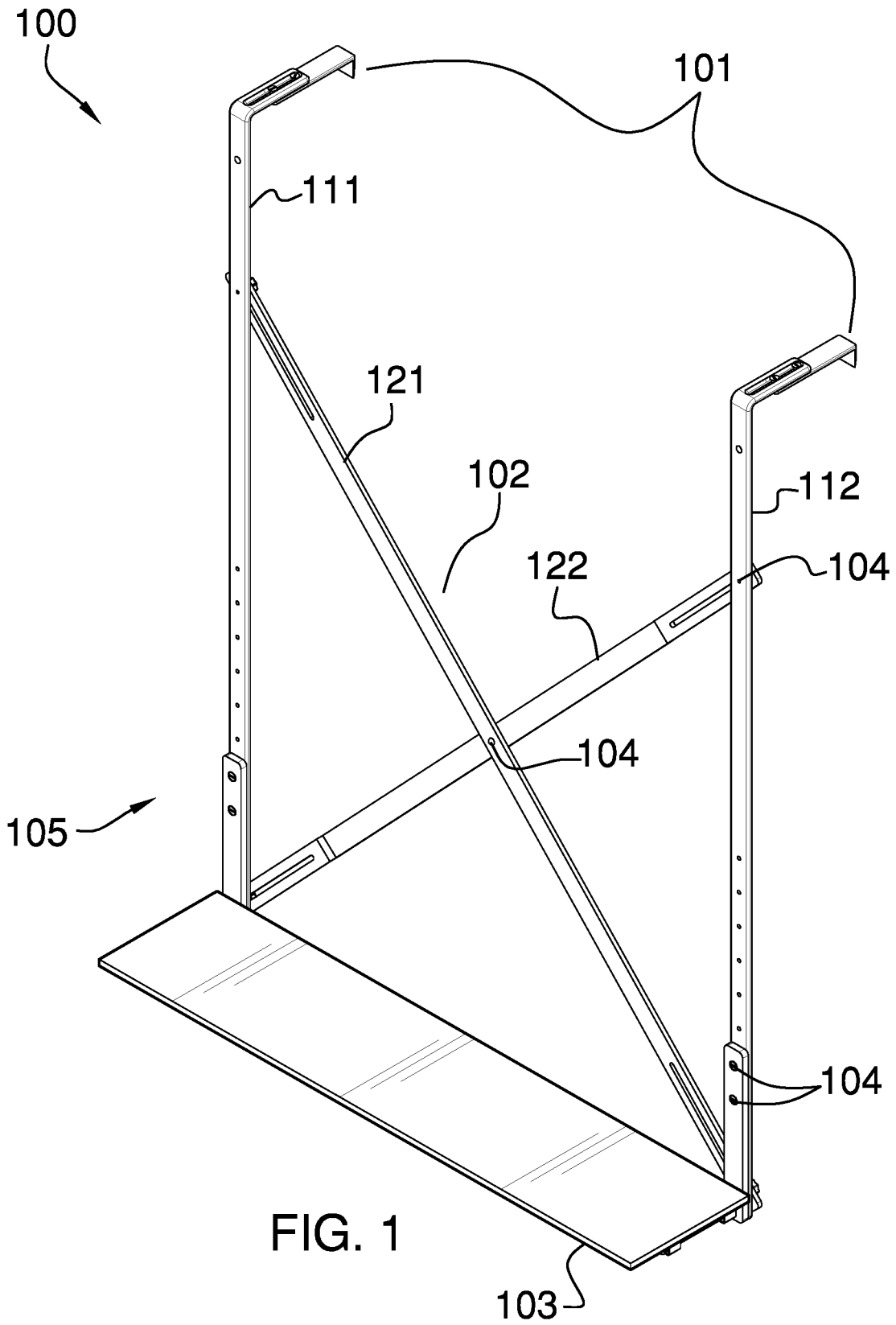
FIG. 1 is an open perspective view of an embodiment of the disclosure.
Figure 2:
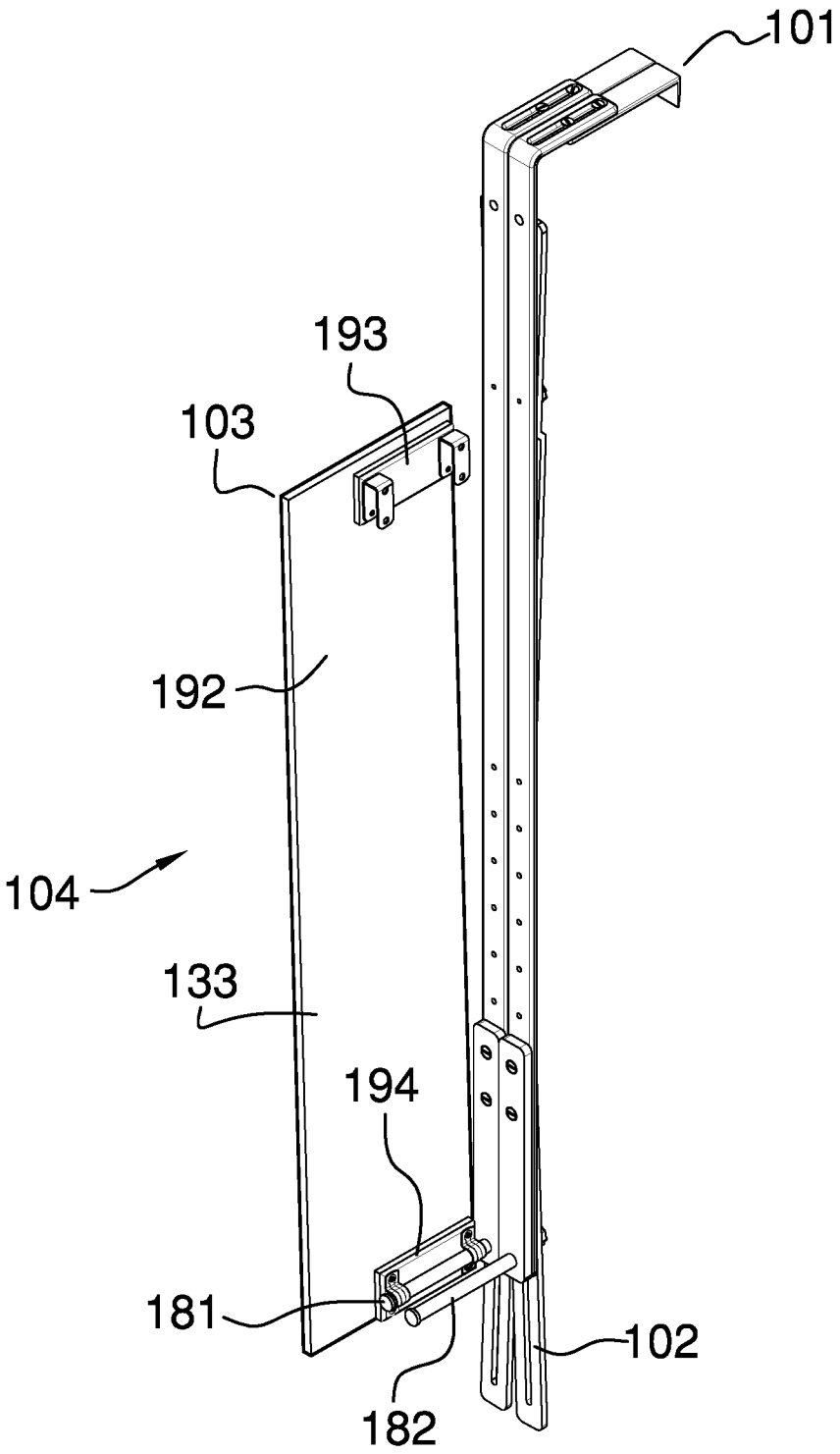
FIG. 2 is a closed perspective view of an embodiment of the disclosure.
Figure 3:
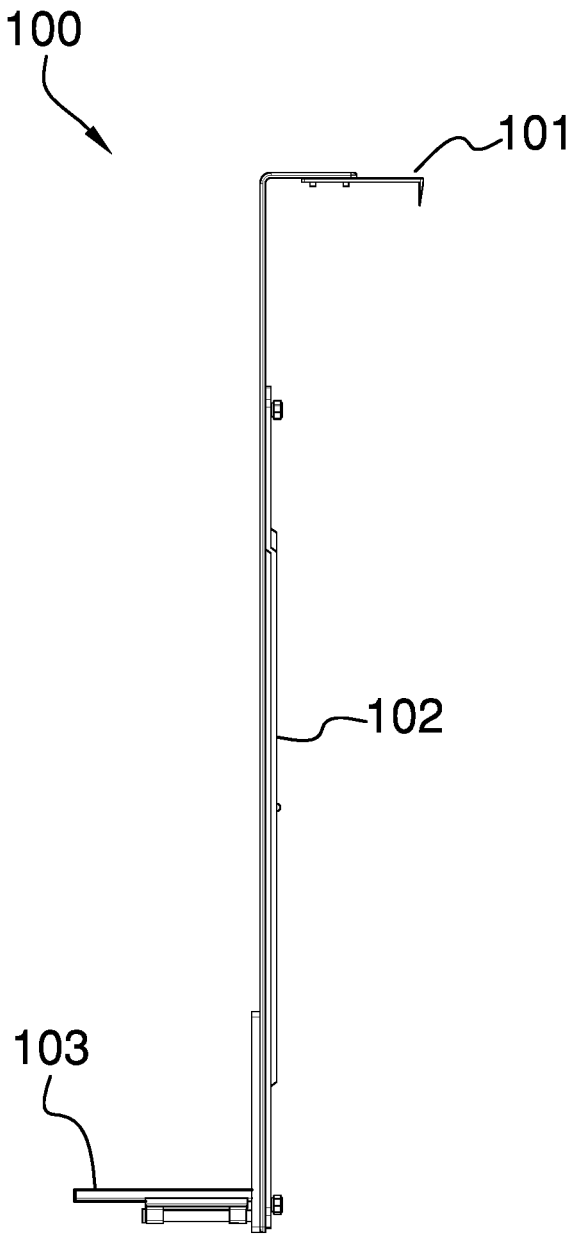
FIG. 3 is a side view of an embodiment of the disclosure.
Figure 4:
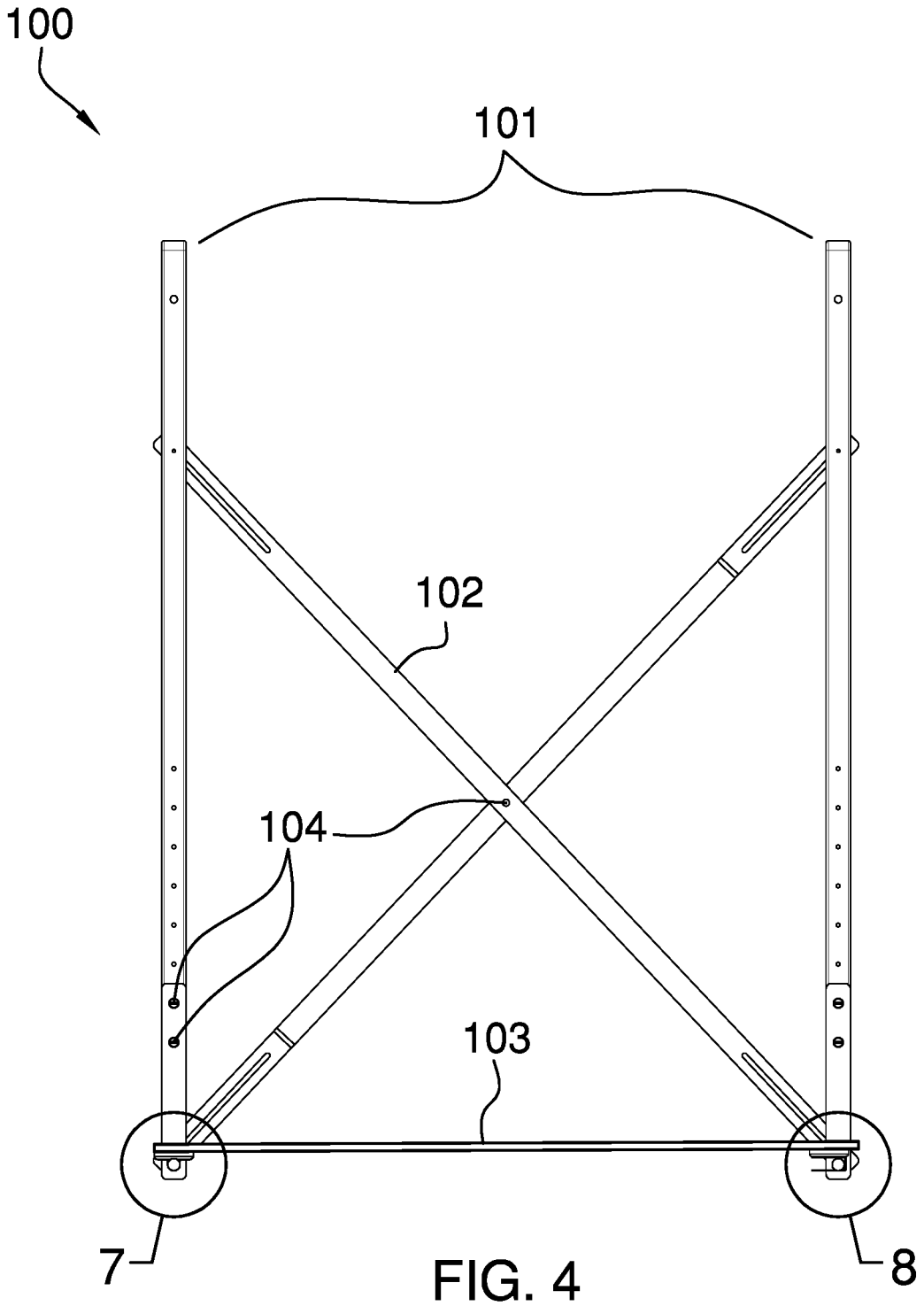
FIG. 4 is a front view of an embodiment of the disclosure.
Figure 5:
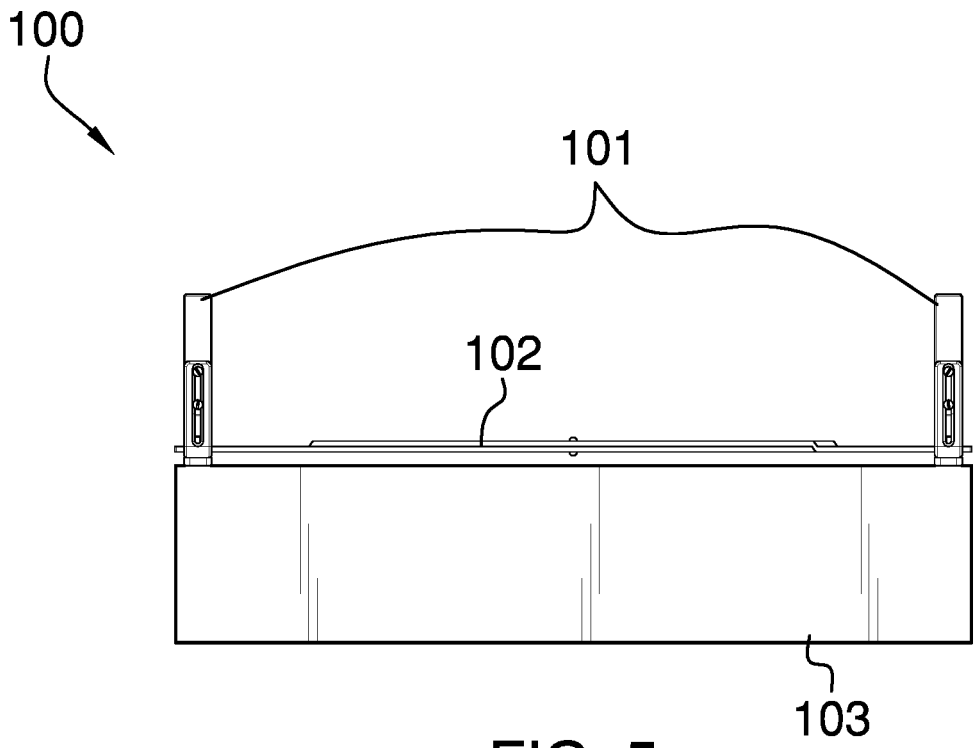
FIG. 5 is a top view of an embodiment of the disclosure.
Figure 6:
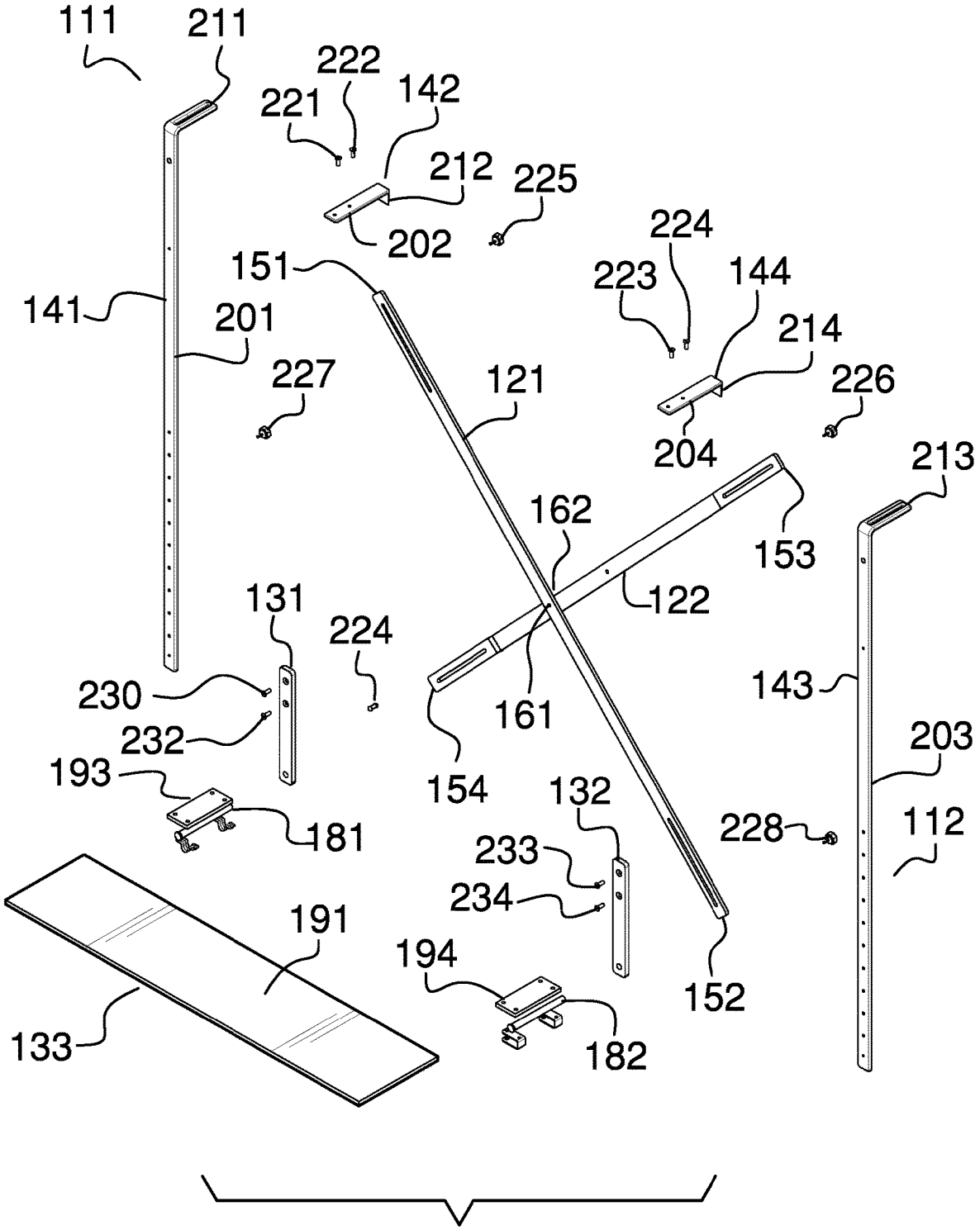
FIG. 6 is an exploded view of an embodiment of the disclosure.
Figure 7:
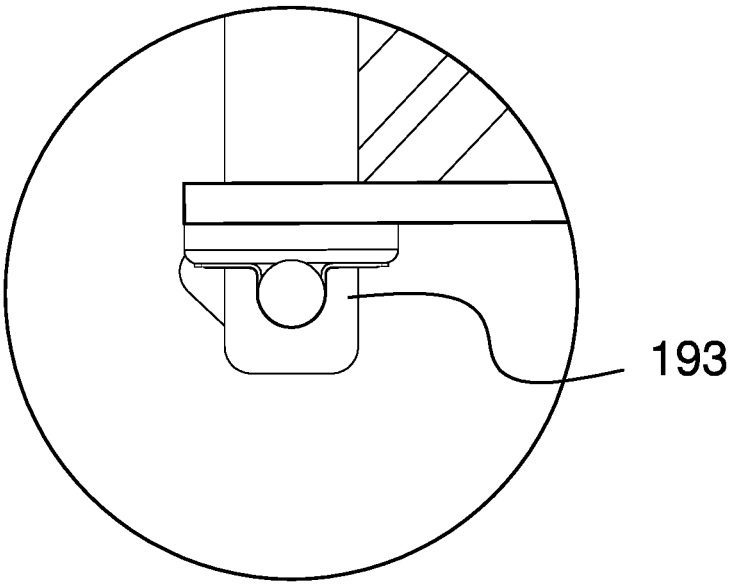
FIG. 7 is a detail view of an embodiment of the disclosure.
Figure 8:
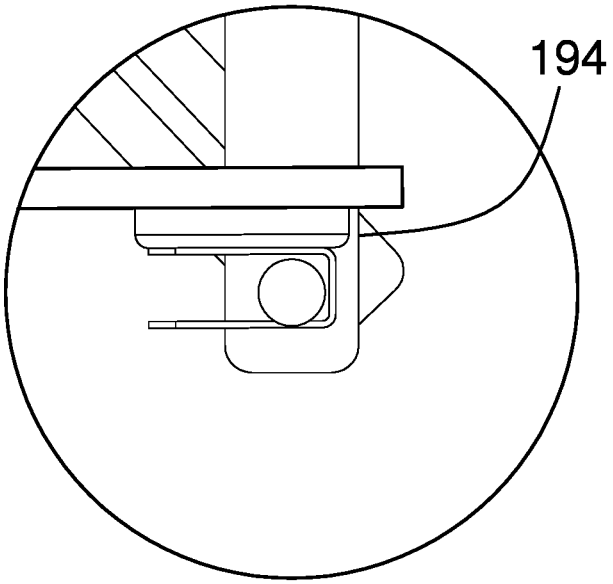
FIG. 8 is a detail view of an embodiment of the disclosure.

Detailed reference will now be made to one or more potential embodiments of the disclosure, which are illustrated in FIGS. 1 through 8.

The underwater dock platform 100 (hereinafter invention) is a platform that is suspended into water. The invention 100 is hung from a structure selected from the group consisting of a vessel or a dock such that a client is supported on the invention 100 while working at the waterline of the selected structure. The invention 100 comprises a plurality of hook structures 101, a plurality of crossbeams 102, a dock platform 103, and a plurality of fasteners 104. The plurality of fasteners 104 assemble the plurality of hook structures 101, the plurality of crossbeams 102, and the dock platform 103 into the invention 100. The plurality of crossbeams 102 brace the plurality of hook structures 101. The dock platform 103 forms a horizontal supporting surface for the client. The invention 100 is a collapsible structure that rotates between a deployed position 105 and a collapsed position 106.

The invention 100 is a rotating structure. The invention 100 is a collapsible structure. The invention 100 rotates between a collapsed position 105 and a deployed position 106 configuration. The collapsed position 105 is the configuration of the invention 100 used for storage. The deployed position 106 is the configuration of the invention 100 that enables the use of the invention 100.

The plurality of hook structures 101 is a mechanical structure. The plurality of hook structures 101 suspends the dock platform 103 from a structure selected from the group consisting of a vessel or a dock. Each of the plurality of hook structures 101 forms a hook structure that secures the invention 100 to the selected structure. The plurality of hook structures 101 comprises a first hook structure 111 and a second hook structure 112.

The first hook structure 111 is a mechanical structure. The first hook structure 111 secures the dock platform 103 to a structure selected from the group consisting of a vessel or a dock. The first hook structure 111 forms a portion of the load path that suspends the dock platform 103 from the selected structure. The first hook structure 111 comprises a first bent flat bar 141 and a second bent flat bar 142.

The first bent flat bar 141 is a non-Euclidean disk structure. The first bent flat bar 141 is a punched flat bar. The punched flat bar is defined elsewhere in this disclosure. The first bent flat bar 141 is formed as a bent plate. The first bent flat bar 141 forms a portion of the vertically oriented element of the load path that transfers the load of the dock platform 103 to the structure selected from the group consisting of a vessel or a dock. The first bent flat bar 141 comprises a first long arm 201 and a first short arm 211.

The first long arm 201 is the section of the bent plate structure of the first bent flat bar 141 with the greatest span of length. The first short arm 211 is the section of the bent plate structure of the first bent flat bar 141 with the major axis that has the lesser span of length.

The second bent flat bar 142 is a non-Euclidean disk structure. The second bent flat bar 142 is a punched flat bar. The punched flat bar is defined elsewhere in this disclosure. The second bent flat bar 142 is a short flat bar. The punched flat bar and the short flat bar are defined elsewhere in this disclosure. The second bent flat bar 142 is formed as a bent plate. The second bent flat bar 142 forms a portion of the vertically oriented element of the load path that transfers the load of the dock platform 103 to the structure selected from the group consisting of a vessel or a dock. The second long arm 202 of the second bent flat bar 142 attaches to the first short arm 211 of the first bent flat bar 141 to form a hook structure. The second bent flat bar 142 comprises a second long arm 202 and a second short arm 212.

The second long arm 202 is the section of the bent plate structure of the second bent flat bar 142 with the major axis that has the greatest span of length. The second short arm 212 is the section of the bent plate structure of the second bent flat bar 142 with the major axis that has the lesser span of length.

The second hook structure 112 is a mechanical structure. The second hook structure 112 secures the dock platform 103 to a structure selected from the group consisting of a vessel or a dock. The second hook structure 112 forms a portion of the load path that suspends the dock platform 103 from the selected structure. In the first potential embodiment of the disclosure, the second hook structure 112 is identical to the first hook structure 111. The second hook structure 112 comprises a third bent flat bar 143 and a fourth bent flat bar 144.

The third bent flat bar 143 is a non-Euclidean disk structure. The third bent flat bar 143 is a punched flat bar. The punched flat bar is defined elsewhere in this disclosure. The third bent flat bar 143 is formed as a bent plate. The third bent flat bar 143 forms a portion of the vertically oriented element of the load path that transfers the load of the dock platform 103 to the structure selected from the group consisting of a vessel or a dock. The third bent flat bar 143 comprises a third long arm 203 and a third short arm 213.

The third long arm 203 is the section of the bent plate structure of the third bent flat bar 143 with the major axis that has the greatest span of length. The third short arm 213 is the section of the bent plate structure of the third bent flat bar 143 with the major axis that has the lesser span of length.

The fourth bent flat bar 144 is a non-Euclidean disk structure. The fourth bent flat bar 144 is a punched flat bar. The punched flat bar is defined elsewhere in this disclosure. The fourth bent flat bar 144 is a short flat bar. The punched flat bar and the short flat bar are defined elsewhere in this disclosure. The fourth bent flat bar 144 is formed as a bent plate. The fourth bent flat bar 144 forms a portion of the vertically oriented element of the load path that transfers the load of the dock platform 103 to the structure selected from the group consisting of a vessel or a dock. The fourth long arm 204 of the fourth bent flat bar 144 attaches to the first short arm 211 of the third bent flat bar 143 to form a hook structure. The fourth bent flat bar 144 comprises a fourth long arm 204 and a fourth short arm 214.

The fourth long arm 204 is the section of the bent plate structure of the fourth bent flat bar 144 with the major axis that has the greatest span of length. The fourth short arm 214 is the section of the bent plate structure of the fourth bent flat bar 144 with the major axis that has the lesser span of length.

The plurality of crossbeams 102 forms a mechanical structure that braces the structure formed by the plurality of hook structures 101. By bracing the structure is meant that the plurality of crossbeams 102: a) locks the relative positions of the plurality of hook structures 101 into a fixed position; and, b) distributes any force received by any individual hook structure throughout the plurality of hook structures 101. The plurality of crossbeams 102 comprises a first flat bar 121 and a second flat bar 122.

The first flat bar 121 is a disk-shaped structure. The first flat bar 121 is a punched flat bar. The punched flat bar is defined elsewhere in this disclosure. The first flat bar 121 braces the first hook structure 111 to the second hook structure 112. The first flat bar 121 comprises a first end 151, a second end 152, and a first midpoint 161. The first end 151 refers to the edge of the first flat bar 121 with the shortest span of length. The second end 152 refers to the edge of the first flat bar 121 that is distal from the first end 151. The first midpoint 161 refers to the center point of the congruent end of the disk structure of the second flat bar 122.

The second flat bar 122 is a disk-shaped structure. The second flat bar 122 is a punched flat bar. The punched flat bar is defined elsewhere in this disclosure. The second flat bar 122 braces the first hook structure 111 to the second hook structure 112. The second flat bar 122 comprises a third end 153, a fourth end 154, and a second midpoint 162. The third end 153 refers to the edge of the second flat bar 122 with the shortest span of length. The fourth end 154 refers to the edge of the second flat bar 122 that is distal from the fourth end 154. The second midpoint 162 refers to the center point of the congruent end of the disk structure of the second flat bar 122.

The dock platform 103 forms the horizontally oriented supporting surface of the invention 100. The dock platform 103 comprises a first mounting structure 131, a second mounting structure 132, and a dock plate 133.

The first mounting structure 131 is a disk-shaped structure. The first mounting structure 131 is a punched flat bar. The punched flat bar is defined elsewhere in this disclosure. The first mounting structure 131 secures the dock platform 103 to the first hook structure 111. The first mounting structure 131 forms a portion of the load path that suspends the dock platform 103 to the plurality of hook structures 101. The first mounting structure 131 further comprises a first supporting shaft 181.

The first supporting shaft 181 is a prism-shaped structure. The first supporting shaft 181 attaches to the congruent end of the first mounting structure 131 that is distal from the first bent flat bar 141. The first supporting shaft 181 forms an anchor point that allows the dock platform 103 to attach to the first hook structure 111. The first supporting shaft 181 attaches to the first mounting structure 131 such that the center axis of the first supporting shaft 181 projects perpendicularly away from the congruent end of the first mounting structure 131.

The second mounting structure 132 is a disk-shaped structure. The second mounting structure 132 is a punched flat bar. The punched flat bar is defined elsewhere in this disclosure. The second mounting structure 132 secures the dock platform 103 to the second hook structure 112. The second mounting structure 132 forms a portion of the load path that suspends the dock platform 103 to the plurality of hook structures 101. The second mounting structure 132 further comprises a second supporting shaft 182.

The second supporting shaft 182 is a prism-shaped structure. The second supporting shaft 182 attaches to the congruent end of the second mounting structure 132 that is distal from the third bent flat bar 143. The second supporting shaft 182 forms an anchor point that allows the dock platform 103 to attach to the second hook structure 112. The second supporting shaft 182 attaches to the second mounting structure 132 such that the center axis of the second supporting shaft 182 projects perpendicularly away from the congruent end of the second mounting structure 132.

The dock plate 133 forms the horizontally oriented supporting surface formed by the dock platform 103. The dock plate 133 is a disk-shaped structure. The dock plate 133 forms the supporting platform of the invention 100. The dock plate 133 comprises a superior surface 191, an inferior surface 192, a hinge structure 193, and a latch structure 194.

The superior surface 191 is the congruent end of the disk structure of the dock plate 133 that is in physical contact with the objects supported by the dock plate 133. The inferior surface 192 is the congruent end of the disk structure of the dock plate 133 that is distal from the superior surface 191.

The hinge structure 193 is a hinge. The hinge is defined elsewhere in this disclosure. The hinge structure 193 is a fastening structure used to attach the dock plate 133 to the first mounting structure 131. The hinge structure 193 is a rotating structure. The hinge structure 193 attaches the inferior surface 192 of the dock plate 133 to the first supporting shaft 181 such that the dock plate 133 rotates relative to the plurality of hook structures 101.

The latch structure 194 is a latch. The latch is defined elsewhere in this disclosure. The latch structure 194 is a fastening structure used to attach the dock plate 133 to the second mounting structure 132. The latch structure 194 removably attaches the inferior surface 192 of the dock plate 133 to the second supporting shaft 182 such that the dock plate 133 maintains a fixed position relative to the plurality of hook structures 101 when the invention 100 is in the deployed position 106.

Each of the plurality of fasteners 104 is a fastening structure used to assemble the plurality of hook structures 101, the plurality of crossbeams 102, and the dock platform 103 into the invention 100. The plurality of fasteners 104 comprises a first fastener 221, a second fastener 222, a third fastener 223, a fourth fastener 224, a fifth fastener 225, a sixth fastener 226, a seventh fastener 227, an eighth fastener 228, a ninth fastener 229, a tenth fastener 230, an eleventh fastener 231, a twelfth fastener 232, and a thirteenth fastener 233.

The first fastener 221 is a rotating structure that attaches the second bent flat bar 142 to the first bent flat bar 141 such that the second bent flat bar 142 rotates relative to the first bent flat bar 141. The first fastener 221 is a locking structure that fixes the position of the second bent flat bar 142 relative to the first bent flat bar 141.

The second fastener 222 is a rotating structure that attaches the second bent flat bar 142 to the first bent flat bar 141 such that the second bent flat bar 142 rotates relative to the first bent flat bar 141. The second fastener 222 is a locking structure that fixes the position of the second bent flat bar 142 relative to the first bent flat bar 141.

The third fastener 223 is a rotating structure that attaches the fourth bent flat bar 144 to the third bent flat bar 143 such that the fourth bent flat bar 144 rotates relative to the third bent flat bar 143. The third fastener 223 is a locking structure that fixes the position of the fourth bent flat bar 144 relative to the third bent flat bar 143.

The fourth fastener 224 is a rotating structure that attaches the fourth bent flat bar 144 to the third bent flat bar 143 such that the fourth bent flat bar 144 rotates relative to the third bent flat bar 143. The fourth fastener 224 is a locking structure that fixes the position of the fourth bent flat bar 144 relative to the third bent flat bar 143.

The fifth fastener 225 is a rotating structure that attaches the first flat bar 121 to the first bent flat bar 141 such that the first flat bar 121 rotates relative to the first bent flat bar 141. The fifth fastener 225 is a locking structure that fixes the position of the first flat bar 121 relative to the first bent flat bar 141.

The sixth fastener 226 is a rotating structure that attaches the first flat bar 121 to the second bent flat bar 142 such that the first flat bar 121 rotates relative to the second bent flat bar 142. The sixth fastener 226 is a locking structure that fixes the position of the first flat bar 121 relative to the second bent flat bar 142.

The seventh fastener 227 is a rotating structure that attaches the second flat bar 122 to the first bent flat bar 141 such that the second flat bar 122 rotates relative to the first bent flat bar 141. The seventh fastener 227 is a locking structure that fixes the position of the second flat bar 122 relative to the first bent flat bar 141.

The eighth fastener 228 is a rotating structure that attaches the second flat bar 122 to the second bent flat bar 142 such that the second flat bar 122 rotates relative to the second bent flat bar 142. The eighth fastener 228 is a locking structure that fixes the position of the second flat bar 122 relative to the second bent flat bar 142.

The ninth fastener 229 is a rotating structure that attaches the second flat bar 122 to the first flat bar 121 such that the second flat bar 122 rotates relative to the first flat bar 121. The ninth fastener 229 is a locking structure that fixes the position of the second flat bar 122 relative to the first flat bar 121.

The tenth fastener 230 is a rigid rotating structure that attaches the first mounting structure 131 to the first bent flat bar 141 such that the first mounting structure 131 maintains a fixed position on the first bent flat bar 141. The eleventh fastener 231 is a rigid rotating structure that attaches the first mounting structure 131 to the first bent flat bar 141 such that the first mounting structure 131 maintains a fixed position on the first bent flat bar 141.

The twelfth fastener 232 is a rigid rotating structure that attaches the second mounting structure 132 to the second bent flat bar 142 such that the second mounting structure 132 maintains a fixed position on the second bent flat bar 142. The thirteenth fastener 233 is a rigid rotating structure that attaches the second mounting structure 132 to the second bent flat bar 142 such that the second mounting structure 132 maintains a fixed position on the second bent flat bar 142.

The following seven paragraphs describe the assembly of the invention 100.

The first fastener 221 secures the inferior face of the second long arm 202 of the second bent flat bar 142 to the superior face of the disk structure of the first short arm 211 of the first bent flat bar 141. The second fastener 222 secures the inferior face of the second long arm 202 of the second bent flat bar 142 to the superior face of the disk structure of the first short arm 211 of the first bent flat bar 141.

The third fastener 223 secures the inferior face of the fourth long arm 204 of the fourth bent flat bar 144 to the superior face of the disk structure of the third short arm 213 of the third bent flat bar 143. The fourth fastener 224 secures the inferior face of the fourth long arm 204 of the fourth bent flat bar 144 to the superior face of the disk structure of the third short arm 213 of the third bent flat bar 143.

The fifth fastener 225 secures the first end 151 of the first flat bar 121 to the lateral face of disk structure of the first bent flat bar 141. The seventh fastener 227 secures the third end 153 of the second flat bar 122 to the lateral face of disk structure of the first bent flat bar 141.

The sixth fastener 226 secures the second end 152 of the first flat bar 121 to the lateral face of disk structure of the third bent flat bar 143. The eighth fastener 228 secures the fourth end 154 of the second flat bar 122 to the lateral face of disk structure of the second bent flat bar 142.

The ninth fastener 229 secures the first midpoint 161 of the first flat bar 121 to the second midpoint 162 of the first flat bar 121.

The tenth fastener 230 secures the face of the disk structure of the first mounting structure 131 to the face of the disk structure of the first bent flat bar 141 at the end of the first bent flat bar 141 that is distal from the second bent flat bar 142. The eleventh fastener 231 secures the face of the disk structure of the first mounting structure 131 to the face of the disk structure of the first bent flat bar 141.

The twelfth fastener 232 secures the face of the disk structure of the second mounting structure 132 to the face of the disk structure of the third bent flat bar 143 at the end of the third bent flat bar 143 that is distal from the fourth bent flat bar 144. The thirteenth fastener 233 secures the face of the disk structure of the second mounting structure 132 to the face of the disk structure of the third bent flat bar 143.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Angle Plate and Bent Plate: As used in this disclosure, an angle plate is a rectangular plate that is bent to form a right angle such that the brink formed by the right angle runs parallel to the major axis of the rectangular plate. When formed from metal, an angle plate is often referred to as an angle iron. A bent plate is a rectangular plate that is bent to form a right angle such that the brink formed by the right angle runs parallel to the minor axis of the rectangular plate. When formed from metal, an angle plate is often referred to as an angle iron.

Brace: As used in this disclosure, a brace is a structural element that is used to support, stabilize, or otherwise steady an object.

C-Channel: As used in this disclosure, the C-channel is a structure that is formed in a U-shape. The C-channel forms a prism shape with a hollow interior and an open face that forms a shape characteristic of the letter C. The open space of the C-channel is often used as a track. An illiterate C-Channel structure refers to a C-Channel structure where: a) the arms of the U-shaped structure of the C-Channel structure are not of equal distances; or b) the crossbeam of the U-shaped structure of the C-Channel structure is selected from the group consisting of a non-Euclidean structure, a curved structure, or a bent structure.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Collapsible: As used in this disclosure, the terms collapsible refers to an object that is configured such that the volume of the object is adjustable. By volume is meant the volume of the perimetrical boundary that contains the object. The verb collapse means that the volume of the object is adjusted from a larger volume to a smaller volume. The verbs expand and deploy mean that the volume of the object is adjusted from a smaller volume to a larger volume.

Client: As used in this disclosure, a client is an individual who is designated to receive the services of the disclosure at bar.

Closed Position: As used in this disclosure, a closed position refers to a movable barrier structure that is in an orientation that minimizes the exterior surface area presented by the movable barrier structure. The closed position is often referred to as an object being "closed."

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Fastener: As used in this disclosure, a fastener is a device that is used to join or affix a first object to a second object.

Fixed End: As used in this disclosure, a fixed end refers to the end of a shaft, pipe, or tube that attaches to an object.

Flat Bar: As used in this disclosure, a flat bar is a metal rectangular disk structure. The span of the length of the major axis of a traditional flat bar is significantly longer than the span of the length of the minor axis of the flat bar. By significantly longer is mean the ratio of the span of the length of the major axis to the span of the length of the minor flat is greater than or equal to 8. A flat bar structure with a length ration of less than eight is referred to as a short flat bar. A punched flat bar is a flat bar that has a plurality of apertures that are formed through the faces of the disk structure of the flat bar. Generally, the center points of the plurality of apertures of a punched flat bar are aligned to be parallel to the major axis of the flat bar. The flat bar is commonly used as a structural element. The flat bar is a readily and commercially available product. The flat bar is also referred to as a flat iron.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Free End: As used in this disclosure, a free end refers to the end of a disk, shaft, pipe, or tube that is not attached to an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hook: As used in this disclosure, a hook is an object that is curved or bent at an angle such that items can be hung on or caught by the object.

Hang: As used in this disclosure, to hang an object is to suspend an object above a surface from above such that the inferior end of the object does not form a significant portion of the load path of the object.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Joint: As used in this disclosure, a joint refers to a point, a line, or a surface that joins a first structure to a second structure.

Latch: As used in this disclosure, a latch is a fastening or locking mechanism. The use of the term latch does not necessarily but often implies the insertion of an object into a notch or cavity.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Lock: As used in this disclosure, a lock is a fastening device that secures a rotating mechanical device into a fixed position.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to the longest edge of a rectangular structure.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that presents an exterior surface area of the movable barrier structure that is greater than the closed position. The open position is often referred to as an object being "open."

Orientation: As used in this disclosure, orientation refers to the positioning of a first object relative to: 1) a second object; or, 2) a fixed position, location, or direction.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Pipe: As used in this disclosure, the term pipe is used to describe a rigid hollow prism. While pipes that are suitable for use in this disclosure are often used to transport or conveys fluids or gases, the purpose of the pipes in this disclosure are structural. In this disclosure, the terms inner dimension of a pipe and outer dimension are used as they would be used by those skilled in the plumbing arts would use inner diameter and outer diameter.

Pipe Clamp: As used in this disclosure, a pipe clamp is a strap like structure that is used to attach an object to a prism-shaped structure. The pipe clamp is a commercially available hardware item. A pipe clamp is commonly marketed as a conduit clamp and a pipe strap.

Pivot: As used in this disclosure, a pivot is a rod or shaft around which an object rotates or swings.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board or a plank.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rotation: As used in this disclosure, rotation refers to the cyclic movement of an object around a fixed point or fixed axis. The verb of rotation is to rotate.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object.

U-Shaped Structure: As used in this disclosure, a U-shaped structure refers to a three-sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of the length of the first arm roughly equals the span of the length of the second arm. The first arm and the second arm project away from the crossbeam in the manner of a cantilever. An illiterate U-shaped structure is a U-shaped structure where the span of the length of the first arm does not equal the span of the length of the second arm.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Vessel: As used in this disclosure, a vessel is a type of vehicle. A vessel transports passengers, goods, or equipment over water.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An underwater dock platform comprising a plurality of hook structures, a plurality of crossbeams, a dock platform, and a plurality of fasteners;

wherein the plurality of fasteners assemble the plurality of hook structures, the plurality of crossbeams, and the dock platform into the underwater dock platform;

wherein the underwater dock platform is a platform;

wherein the underwater dock platform is hung from a structure selected from the group consisting of a vessel or a dock such that a client is supported on the underwater dock platform while working at the waterline of the selected structure;

wherein the plurality of crossbeams brace the plurality of hook structures;

wherein the dock platform forms a horizontal supporting surface for the client;

wherein the underwater dock platform is a collapsible structure that rotates between a deployed position and a collapsed position;

wherein the plurality of crossbeams comprises a first flat bar and a second flat bar;

wherein the plurality of hook structures comprises a first hook structure and a second hook structure, and wherein the first flat bar attaches to the first hook structure and the second hook structure;

wherein the second flat bar attaches to the first hook structure and the second hook structure;

wherein the first flat bar attaches to the second flat bar;

wherein the plurality of fasteners comprises a first fastener, a second fastener, a third fastener, a fourth fastener, a fifth fastener, a sixth fastener, a seventh fastener, an eighth fastener, a ninth fastener, a tenth fastener, an eleventh fastener, a twelfth fastener, and a thirteenth fastener;

wherein the first hook structure further comprises a first bent flat bar, wherein the first fastener is a locking structure that attaches a second bent flat bar to the first bent flat bar and adjustably fixes the position of the second bent flat bar relative to the first bent flat bar; and wherein the second fastener is a locking structure that attaches the second bent flat bar to the first bent flat bar and adjustably fixes the position of the second bent flat relative to the first bent flat bar.

2. The underwater dock platform according to claim 1 wherein the plurality of hook structures is a mechanical structure;

wherein the plurality of hook structures suspends the dock platform from a structure selected from the group consisting of a vessel or a dock;

wherein each of the plurality of hook structures forms a hook structure that secures the underwater dock platform to the selected structure.

3. The underwater dock platform according to claim 2 wherein the plurality of crossbeams forms a mechanical structure that braces the structure formed by the plurality of hook structures;

wherein by bracing the structure is meant that the plurality of crossbeams: a) locks the relative positions of the plurality of hook structures into a fixed position; and, b) distributes any force received by any individual hook structure throughout the plurality of hook structures.

4. The underwater dock platform according to claim 3 wherein the first hook structure is a mechanical structure;

wherein the first hook structure secures the dock platform to a structure selected from the group consisting of a vessel or a dock;

wherein the first hook structure forms a portion of the load path that suspends the dock platform from the selected structure;

wherein the second hook structure is a mechanical structure;

wherein the second hook structure secures the dock platform to a structure selected from the group consisting of a vessel or a dock;

wherein the second hook structure forms a portion of the load path that suspends the dock platform from the selected structure;

wherein the second hook structure is identical to the first hook structure.

5. The underwater dock platform according to claim 4 wherein the dock platform forms the horizontally oriented supporting surface of the underwater dock platform;

wherein the dock platform comprises a first mounting structure, a second mounting structure, and a dock plate;

wherein the first mounting structure forms a portion of the load path that suspends the dock platform to the plurality of hook structures;

wherein the second mounting structure forms a portion of the load path that suspends the dock platform to the plurality of hook structures.

6. The underwater dock platform according to claim 5 wherein the second hook structure further comprises a third bent flat bar, wherein the third fastener is a locking structure that attaches a fourth bent flat bar to the third bent flat bar and adjustably fixes the position of the fourth bent flat bar relative to the third bent flat bar;

locking structure that attaches the fourth bent flat bar to the third bent flat bar and adjustably fixes the position of the fourth bent flat wherein the fifth fastener is a rotating structure that attaches the first flat bar to the first bent flat bar such that the first flat bar rotates relative to the first bent flat bar;

wherein the fifth fastener is a locking structure that fixes the position of the first flat bar relative to the first bent flat bar;

wherein the sixth fastener is a rotating structure that attaches the first flat bar to the second bent flat bar such that the first flat bar rotates relative to the second bent flat bar;

wherein the sixth fastener is a locking structure that fixes the position of the first flat bar relative to the second bent flat bar;

wherein the seventh fastener is a rotating structure that attaches the second flat bar to the first bent flat bar such that the second flat bar rotates relative to the first bent flat bar;

wherein the seventh fastener is a locking structure that fixes the position of the second flat bar relative to the first bent flat bar;

wherein the eighth fastener is a rotating structure that attaches the second flat bar to the second bent flat bar such that the second flat bar rotates relative to the second bent flat bar;

wherein the eighth fastener is a locking structure that fixes the position of the second flat bar relative to the second bent flat bar;

wherein the ninth fastener is a rotating structure that attaches the second flat bar to the first flat bar such that the second flat bar rotates relative to the first flat bar;

wherein the ninth fastener is a locking structure that fixes the position of the second flat bar relative to the first flat bar;

wherein the tenth fastener is a rigid rotating structure that attaches the first mounting structure to the first bent flat bar such that the first mounting structure maintains a fixed position on the first bent flat bar;

wherein the eleventh fastener is a rigid rotating structure that attaches the first mounting structure to the first bent flat bar such that the first mounting structure maintains a fixed position on the first bent flat bar;

wherein the twelfth fastener is a rigid rotating structure that attaches the second mounting structure to the second bent flat bar such that the second mounting structure maintains a fixed position on the second bent flat bar;

wherein the thirteenth fastener is a rigid rotating structure that attaches the second mounting structure to the second bent flat bar such that the second mounting structure maintains a fixed position on the second bent flat bar.

7. The underwater dock platform according to claim 6 wherein the first hook structure comprises a first bent flat bar and a second bent flat bar;

wherein the second hook structure comprises a third bent flat bar and a fourth bent flat bar;

wherein the second bent flat bar attaches to the first bent flat bar;

wherein the fourth bent flat bar attaches to the third bent flat bar.

8. The underwater dock platform according to claim 7 wherein the first bent flat bar is a non-Euclidean disk structure;

wherein the first bent flat bar is a punched flat bar;

wherein the first bent flat bar is formed as a bent plate;

wherein the first bent flat bar forms a portion of the vertically oriented element of the load path that transfers the load of the dock platform to the structure selected from the group consisting of a vessel or a dock;

wherein the first bent flat bar comprises a first long arm and a first short arm;

wherein the first long arm is the section of the bent plate structure of the first bent flat bar with the greatest span of length;

wherein the first short arm is the section of the bent plate structure of the first bent flat bar with the major axis that has the lesser span of length.

9. The underwater dock platform according to claim 8 wherein the second bent flat bar is a non-Euclidean disk structure;

wherein the second bent flat bar is a punched flat bar;

wherein the second bent flat bar is a short flat bar;

wherein the second bent flat bar is formed as a bent plate;

wherein the second bent flat bar forms a portion of the vertically oriented element of the load path that transfers the load of the dock platform to the structure selected from the group consisting of a vessel or a dock;

wherein the second long arm of the second bent flat bar attaches to the first short arm of the first bent flat bar to form a hook structure;

wherein the second bent flat bar comprises a second long arm and a second short arm;

wherein the second long arm is the section of the bent plate structure of the second bent flat bar with the major axis that has the greatest span of length;

wherein the second short arm is the section of the bent plate structure of the second bent flat bar with the major axis that has the lesser span of length.

10. The underwater dock platform according to claim 9 wherein the third bent flat bar is a non-Euclidean disk structure;

wherein the third bent flat bar is a punched flat bar;

wherein the third bent flat bar is formed as a bent plate;

wherein the third bent flat bar forms a portion of the vertically oriented element of the load path that transfers the load of the dock platform to the structure selected from the group consisting of a vessel or a dock;

wherein the third bent flat bar comprises a third long arm and a third short arm;

wherein the third long arm is the section of the bent plate structure of the third bent flat bar with the major axis that has the greatest span of length;

wherein the third short arm is the section of the bent plate structure of the third bent flat bar with the major axis that has the lesser span of length.

11. The underwater dock platform according to claim 10 wherein the fourth bent flat bar is a non-Euclidean disk structure;

wherein the fourth bent flat bar is a punched flat bar;

wherein the fourth bent flat bar is a short flat bar;

wherein the fourth bent flat bar is formed as a bent plate;

wherein the fourth bent flat bar forms a portion of the vertically oriented element of the load path that transfers the load of the dock platform to the structure selected from the group consisting of a vessel or a dock;

wherein the fourth long arm of the fourth bent flat bar attaches to the first short arm of the third bent flat bar to form a hook structure;

wherein the fourth bent flat bar comprises a fourth long arm and a fourth short arm;

wherein the fourth long arm is the section of the bent plate structure of the fourth bent flat bar with the major axis that has the greatest span of length;

wherein the fourth short arm is the section of the bent plate structure of the fourth bent flat bar with the major axis that has the lesser span of length.

12. The underwater dock platform according to claim 11 wherein the first flat bar is a disk-shaped structure;

wherein the first flat bar is a punched flat bar;

wherein the first flat bar braces the first hook structure to the second hook structure;

wherein the first flat bar comprises a first end, a second end, and a first midpoint;

wherein the first end refers to the edge of the first flat bar with the shortest span of length;

wherein the second end refers to the edge of the first flat bar that is distal from the first end;

wherein the first midpoint refers to the center point of the congruent end of the disk structure of the second flat bar.

13. The underwater dock platform according to claim 12 wherein the second flat bar is a disk-shaped structure;

wherein the second flat bar is a punched flat bar;

wherein the second flat bar braces the first hook structure to the second hook structure;

wherein the second flat bar comprises a third end, a fourth end, and a second midpoint;

wherein the third end refers to the edge of the second flat bar with the shortest span of length;

wherein the fourth end refers to the edge of the second flat bar that is distal from the fourth end;

wherein the second midpoint refers to the center point of the congruent end of the disk structure of the second flat bar.

14. The underwater dock platform according to claim 13 wherein the first mounting structure is a disk-shaped structure;

wherein the first mounting structure is a punched flat bar;

wherein the first mounting structure secures the dock platform to the first hook structure;

wherein the first mounting structure forms a portion of the load path that suspends the dock platform to the plurality of hook structures;

wherein the first mounting structure further comprises a first supporting shaft;

wherein the first supporting shaft attaches to the congruent end of the first mounting structure that is distal from the first bent flat bar;

wherein the first supporting shaft forms an anchor point that allows the dock platform to attach to the first hook structure;

wherein the first supporting shaft attaches to the first mounting structure such that the center axis of the first supporting shaft projects perpendicularly away from the congruent end of the first mounting structure.

15. The underwater dock platform according to claim 14 wherein the second mounting structure is a disk-shaped structure;

wherein the second mounting structure is a punched flat bar;

wherein the second mounting structure secures the dock platform to the second hook structure;

wherein the second mounting structure further comprises a second supporting shaft;

wherein the second supporting shaft attaches to the congruent end of the second mounting structure that is distal from the third bent flat bar;

wherein the second supporting shaft forms an anchor point that allows the dock platform to attach to the second hook structure;

wherein the second supporting shaft attaches to the second mounting structure such that the center axis of the second supporting shaft projects perpendicularly away from the congruent end of the second mounting structure.

16. The underwater dock platform according to claim 15 wherein the dock plate forms the horizontally oriented supporting surface formed by the dock platform;

wherein the dock plate is a disk-shaped structure;

wherein the dock plate forms the supporting platform of the underwater dock platform.

17. The underwater dock platform according to claim 16 wherein the dock plate comprises a superior surface, an inferior surface, a hinge structure, and a latch structure;

wherein the superior surface is the congruent end of the disk structure of the dock plate that is in physical contact with the objects supported by the dock plate;

wherein the inferior surface is the congruent end of the disk structure of the dock plate that is distal from the superior surface;

wherein the hinge structure is a hinge;

wherein the hinge structure is a fastening structure used to attach the dock plate to the first mounting structure;

wherein the hinge structure is a rotating structure;

wherein the latch structure is a latch;

wherein the latch structure is a fastening structure used to attach the dock plate to the second mounting structure.

18. The underwater dock platform according to claim 17 wherein the hinge structure attaches the inferior surface of the dock plate to the first supporting shaft such that the dock plate rotates relative to the plurality of hook structures;

wherein the latch structure removably attaches the inferior surface of the dock plate to the second supporting shaft such that the dock plate maintains a fixed position relative to the plurality of hook structures when the underwater dock platform is in the deployed position.

19. The underwater dock platform according to claim 18 wherein the first fastener secures the inferior face of the second long arm of the second bent flat bar to the superior face of the disk structure of the first short arm of the first bent flat bar;

wherein the second fastener secures the inferior face of the second long arm of the second bent flat bar to the superior face of the disk structure of the first short arm of the first bent flat bar;

wherein the third fastener secures the inferior face of the fourth long arm of the fourth bent flat bar to the superior face of the disk structure of the third short arm of the third bent flat bar;

wherein the fourth fastener secures the inferior face of the fourth long arm of the fourth bent flat bar to the superior face of the disk structure of the third short arm of the third bent flat bar;

wherein the fifth fastener secures the first end of the first flat bar to the lateral face of disk structure of the first bent flat bar;

wherein the seventh fastener secures the third end of the second flat bar to the lateral face of disk structure of the first bent flat bar;

wherein the sixth fastener secures the second end of the first flat bar to the lateral face of disk structure of the third bent flat bar;

wherein the eighth fastener secures the fourth end of the second flat bar to the lateral face of disk structure of the second bent flat bar;

wherein the ninth fastener secures the first midpoint of the first flat bar to the second midpoint of the first flat bar;

wherein the tenth fastener secures the face of the disk structure of the first mounting structure to the face of the disk structure of the first bent flat bar at the end of the first bent flat bar that is distal from the second bent flat bar;

wherein the eleventh fastener secures the face of the disk structure of the first mounting structure to the face of the disk structure of the first bent flat bar;

wherein the twelfth fastener secures the face of the disk structure of the second mounting structure to the face of the disk structure of the third bent flat bar at the end of the third bent flat bar that is distal from the fourth bent flat bar;

wherein the thirteenth fastener secures the face of the disk structure of the second mounting structure to the face of the disk structure of the third bent flat bar.

* * * * *